US007104165B2

(12) United States Patent
Chu

(10) Patent No.: US 7,104,165 B2
(45) Date of Patent: Sep. 12, 2006

(54) SWING HEAD STRUCTURE OF WRENCH WITH TWO KINDS OF TORQUE OUTPUT

(76) Inventor: Te-Chen Chu, No. 369, Si Hu Road, Da Li, Taichung Hsien (TW) 412

( * ) Notice: Subject to any disclaimer, the term of this patent is extended or adjusted under 35 U.S.C. 154(b) by 105 days.

(21) Appl. No.: 10/759,872

(22) Filed: Jan. 16, 2004

(65) Prior Publication Data

US 2005/0155468 A1 Jul. 21, 2005

(51) Int. Cl.
*B25B 23/16* (2006.01)
*B25B 13/00* (2006.01)
*B25G 1/00* (2006.01)

(52) U.S. Cl. ..... 81/177.8; 81/177.7; 81/177.75; 81/177.85; 81/177.9; 81/58.1

(58) Field of Classification Search .... 81/177.7–177.9, 81/58.1

See application file for complete search history.

(56) References Cited

U.S. PATENT DOCUMENTS 1,324,258 A * 12/1919 Lewis ..... 81/57.26
2,791,142 A * 5/1957 Lyon ..... 81/57.26
4,296,654 A * 10/1981 Mercer ..... 81/57.26
5,784,934 A * 7/1998 Izumisawa ..... 81/57.26
6,070,499 A * 6/2000 Wisbey ..... 81/57.29
6,220,125 B1 * 4/2001 Lan ..... 81/177.9
6,311,584 B1 * 11/2001 Chu ..... 81/57.29
6,457,386 B1 * 10/2002 Chiang ..... 81/62
2003/0015070 A1 * 1/2003 Chen ..... 81/177.9

* cited by examiner

*Primary Examiner*—Joseph J. Hail, III
*Assistant Examiner*—Bryan Muller
(74) *Attorney, Agent, or Firm*—Charles E. Baxley

(57) ABSTRACT

A swing head structure of a wrench with two kinds of torque output includes a head part and a handle pivotally coupled together by a shaft, the wrench can also be used as a ratchet wrench or can rotate the handle backwards and forwards to make the head part to rotate in one direction, the rotating direction can be changed, the swinging movement of the head part does not affect the rotation and transmission of the wrench and the handle, the swinging head part includes two kinds of torque output to the wrench.

3 Claims, 10 Drawing Sheets

SWING HEAD STRUCTURE OF WRENCH WITH TWO KINDS OF TORQUE OUTPUT

BACKGROUND OF THE INVENTION

A swing head structure of a wrench with two kinds of torque output includes a head part and a handle pivotally coupled together by a shaft, the wrench can also be used as a ratchet wrench or can rotate the handle backwards and forwards to make the head part to rotate in one direction, the rotating direction can be changed, the swinging movement of the head part does not affect the rotation and transmission of the wrench and the handle, the swinging head part having two kinds of torque output to the wrench.

The U.S. Pat. No. 6,311,583 and Taiwan patent with publication no. 553808 of "A Ratchet Wrench", both include a head part which can rotate corresponding to the handle part, but their functions are too simple and have complicated structures.

SUMMARY OF THE INVENTION

The main purpose of the present invention is to provide a swing head structure of a wrench with two kinds of torque output. The wrench comprises a head part and a handle, the handle can be made as a combination of a long shaft and a handle part, the head part comprises a sleeve socket, a ratchet head and a switching-control part. The head part can be swung in different angles and positioned by a shaft. The wrench can be used as a general ratchet wrench or can rotate the handle forward and backward to make the head part rotate in one direction, the rotating direction can be changed by a switch-control mechanism. The swinging movement of the head part does not affect the rotation and transmission of the wrench and the handle. The swinging head part also includes two kinds of torque output to the wrench.

The present invention will become more fully understood by reference to the following detailed description when read in conjunction with the attached drawings.

DETAILED DESCRIPTION OF THE PREFERRED EMBODIMENT

Figure 1:
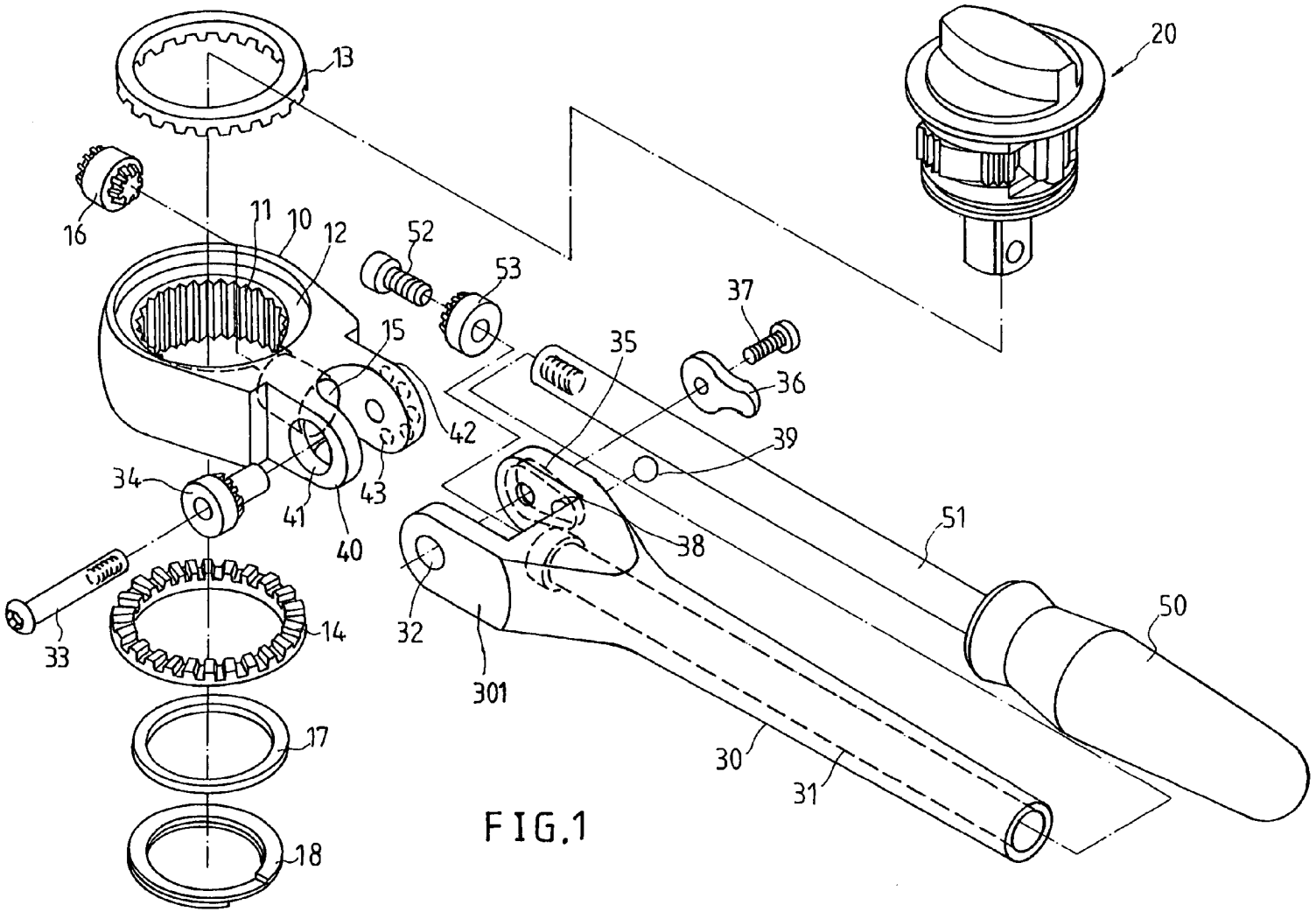
FIG. 1 is an exploded view of a swing head structure of a wrench with two kinds of torque output.
Figure 2:
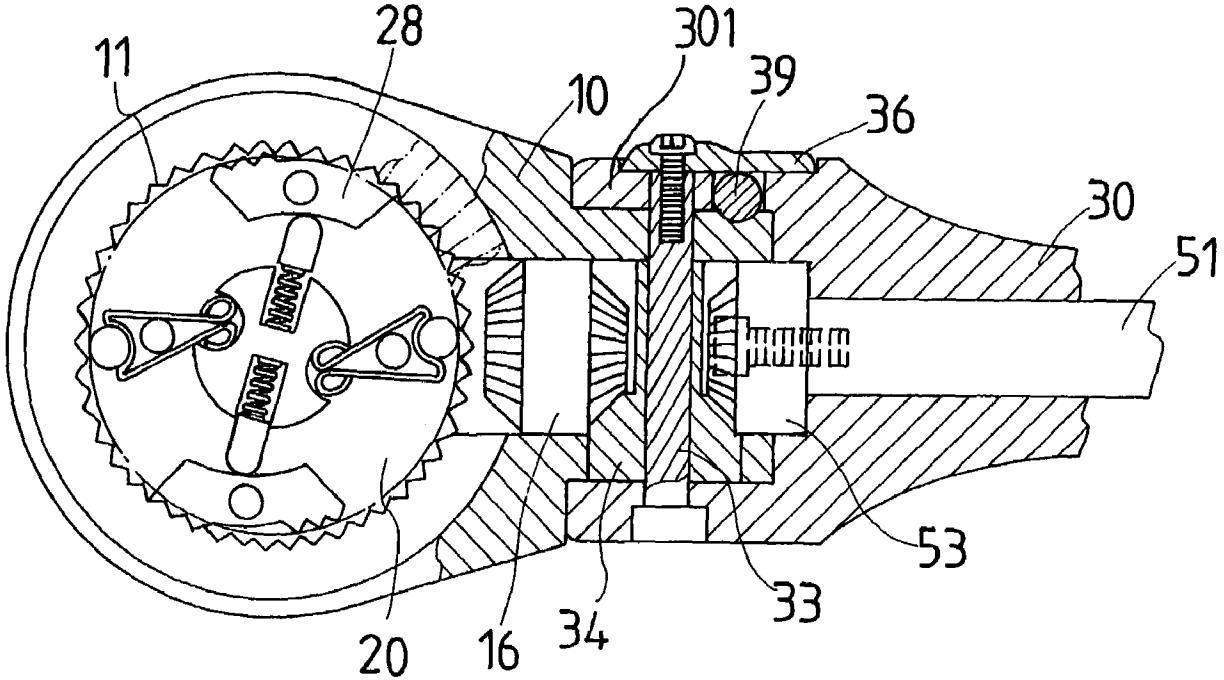
FIG. 2 is a partial cross sectional view of the swing head structure of the wrench.

Referring to FIGS. 1 and 2, the present invention of a swing head structure of a wrench with two kinds of torque output, comprises a sleeve socket 10, with ratchet teeth 11 disposed on its inner circumference, its upper and bottom sides each having a trough 12 for placing ring-shaped gears 13 and 14 respectively. The sleeve socket 10 includes a compartment 15 formed in its one side along its axial direction for placing a transmission gear 16, the teeth shape of the transmission gear 16 can mesh with the ring-shaped gears 13 and 14.

Figure 8:
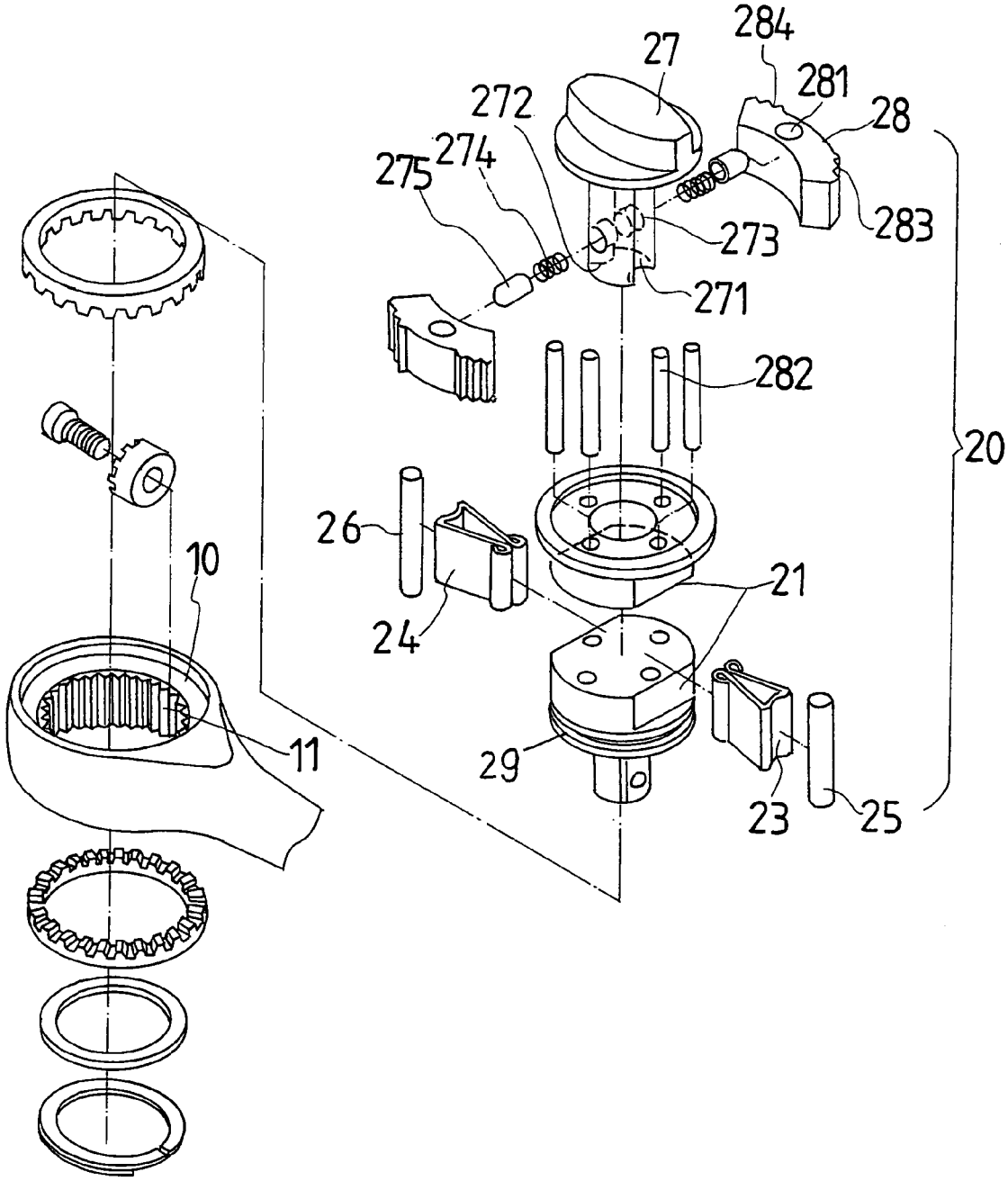
FIG. 8 is an exploded view illustrating another embodiment of the wrench.

Referring to FIG. 8, the present invention also comprises a ratchet head 20, which having a dual-surfaces 21 for assembling bent elastic pieces 23 and 24, as well as circular rods 25 and 26 respectively. The front portions of the bent elastic pieces 23 and 24 are bent in such a way to limit and position the circular rods 25 and 26, while the back sections of the bent elastic pieces 23 and 24 are pressed against curved troughs 271 and 272 of a control switch 27 respectively. The other side of the control switch 27 includes a hole 273 for placing springs 274 and pressing elements 275. Two curved pressing pieces 28 each include a central hole 281 for rotatably inserting a rod 282. When the curved pressing pieces 28 are pressed by the springs 274 and the pressing elements 275 to one side, ratchet gears 283 and 284 of the curved pressing pieces 28 are selectively pressed against the ratchet teeth 11 of the sleeve socket 10, in order to change rotating direction.

A long shaft 30 includes a long hollow hole 31 formed along its axial direction, and a protruded ear 301 disposed on its front part, a hole 32 is formed in the ear 301 for inserting a bolt 33 and a medium gear 34. The sleeve socket 10 includes a protruded ear 40 having a hole 41 formed therein for rotatably receiving the bolt 33. A trough 35 is formed in one side of the protruded ear 301, a switch-control 36 is placed inside the trough 35 and secured to the protruded ear 301 by using a screw 37 and the bolt 33, the protruded ear 301 includes a ball hole 38 formed therein and communicating with the trough 35 for placing a steel ball 39 which is engageable with a concave dot 43 that is formed in a concave surface 42 of the protruded ear 40. When the switch-control 36 is not pressed against the steel ball 39, the sleeve socket 10 can rotate and swing freely. When the switch-control 36 is pressed against the steel ball 39 which is intern pressed against the concave dot 43 of the protruded ear 40, the sleeve socket 10 can be positioned.

A handle 50 includes a long round shaft 51 inserted through the long hollow hole 31 of the long shaft 30. A screw 52 is used to lock a transmission gear 53 onto the front part of the round shaft 51.

Referring to FIGS. 1, 2, 3 and 8, when assembling, the curved pressing piece 28 is positioned by the rod 282, and the spring 274 and the pressing element 275 are inserted into the hole 273 of the control switch 27 to press against the curved pressing piece 28. Curved elastic pieces 23 and 24 as well as circular rods 25 and 26 are also assembled on the ratchet head 20. The ring-shaped gear 13 and the ratchet head 20 are inserted into the sleeve socket 10. The ring-shaped gear 14 is also inserted into the sleeve socket 10 on the other side, then by using a pad ring 17 and a spring pad 18 for being retained within a trough 29 of the ratchet head 20, so that the ratchet head 20 and related elements will not be disengaged from the sleeve socket 10. The round shaft 51 of the handle 50 is engaged through the long hollow hole 31 of the long shaft 30, and then using the screw 52 to lock the transmission gear 53 onto the front part of the round shaft 51. The hole 32 of the long hollow shaft 30 is aligned with the hole 41 of the sleeve socket 10, for assembling the medium gear 34 and the bolt 33 therein. The ball hole 38 of the long shaft 30 is for placing the steel ball 39, the switch-control 36 is used to press against the steel ball 39, then the screw 37 is used to bolt the switch-control 36 onto the bolt 33.

Figure 4:
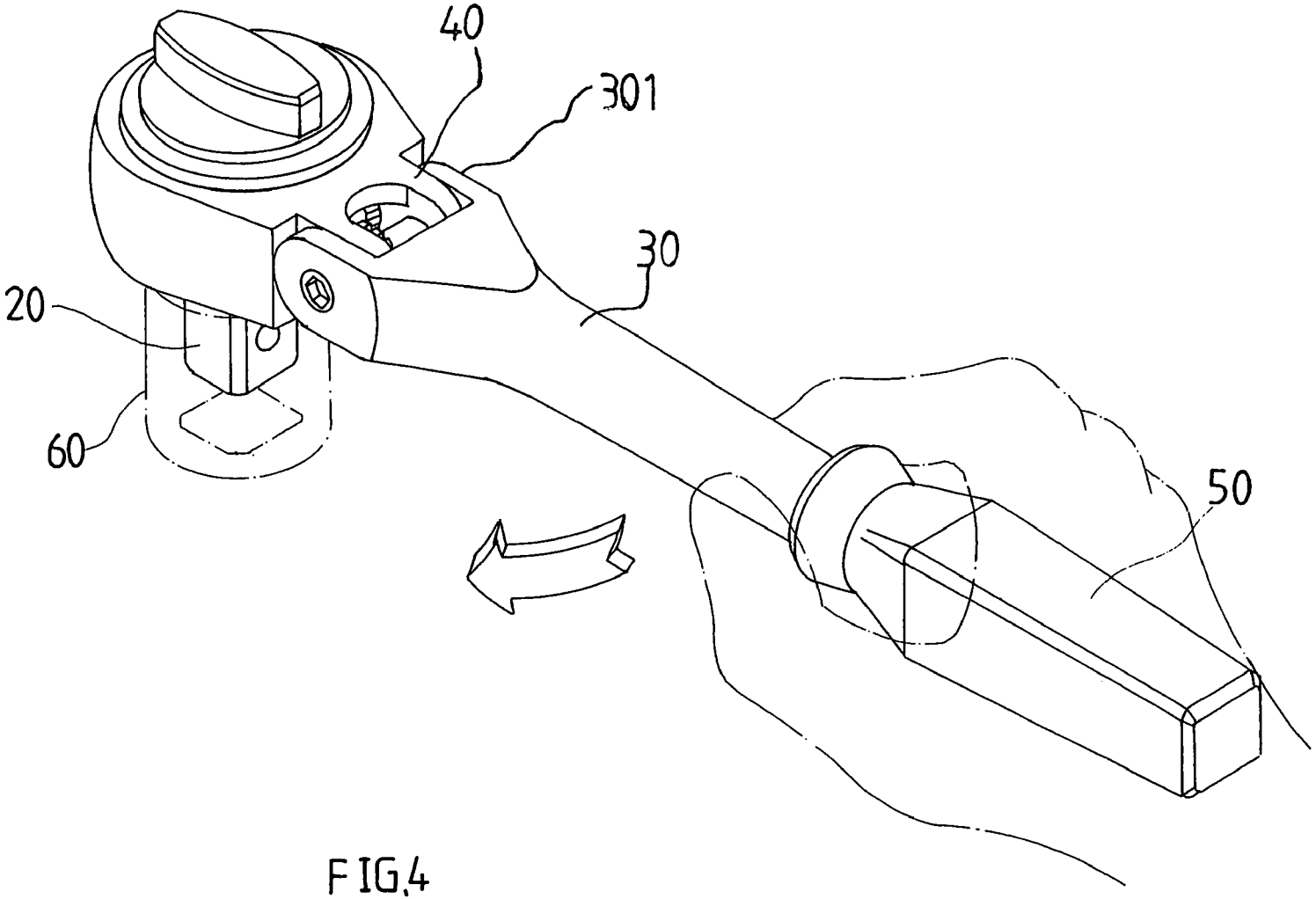
FIG. 4 is a perspective view illustrating the operation of the swing head structure.

Referring to FIG. 4, the present invention may be used as a wrench. It uses the ratchet head 20 having a sleeve part 60 which can be engaged on a bolt. Hold the handle 50 and move it back and forth on the same level, the ratchet head 20 can be rotated to the opposite direction by having the curved pressing piece 28 meshed with the gear 11 (referring to FIG. 2). The switch-control 27 may be rotated to change to either idling or transmission direction (referring to FIG. 8).

Figure 5:
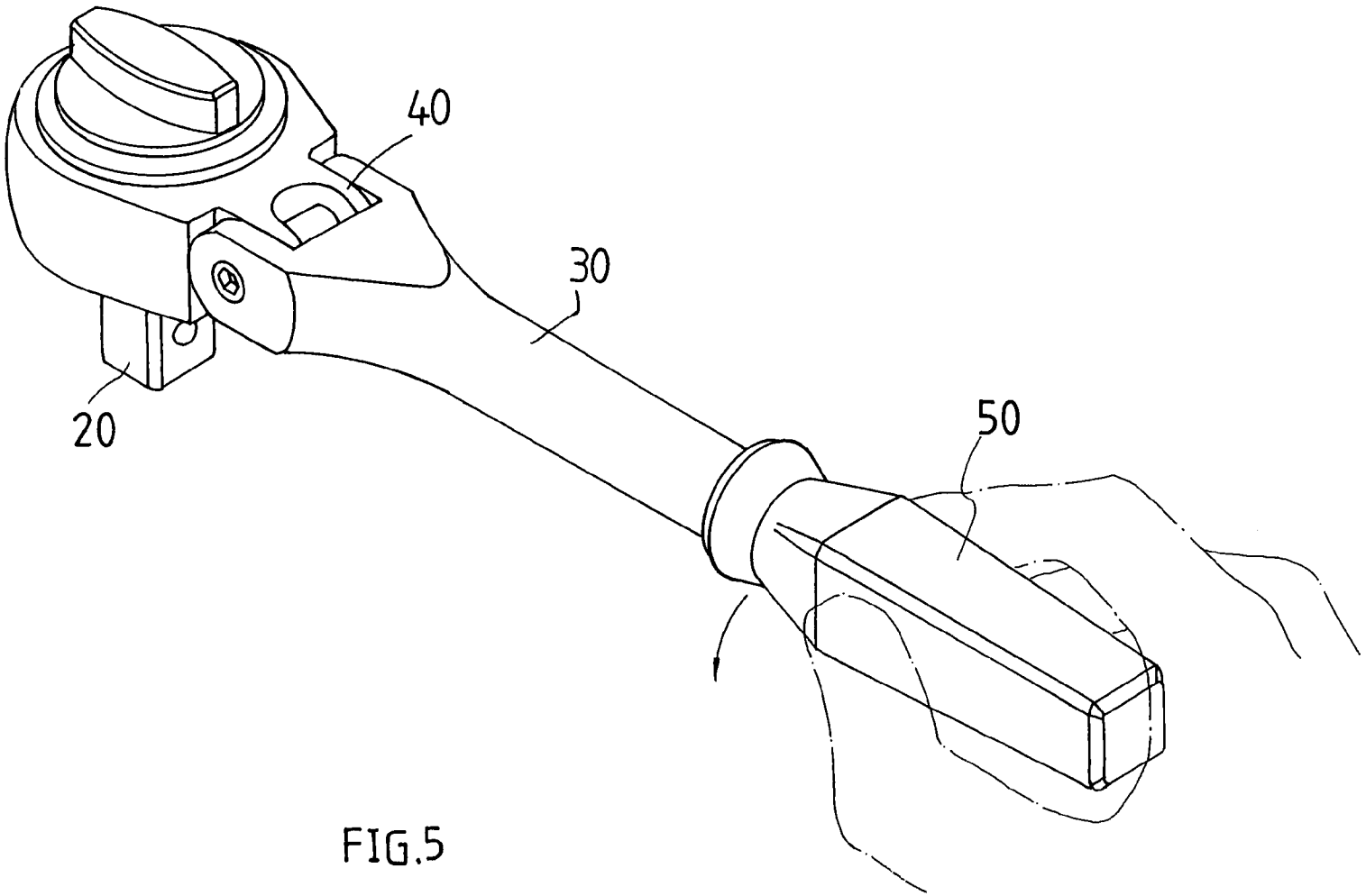
FIG. 5 is a perspective view illustrating the rotational operation of the swing head structure.

Referring to FIG. 5, by quickly turning the handle 50 to transmit the rotating force to the medium gear 34 through the transmission gear 53 (referring to FIG. 2), then to the transmission gear 16 through the medium gear 34, the transmission gear 16 may then make the ring-shaped gears 13 and 14 rotate (referring to FIG. 1). The ratchet head 20 can be controlled by the circular rods 25 and 26 either to be rotated or to be idled.

Figure 3:
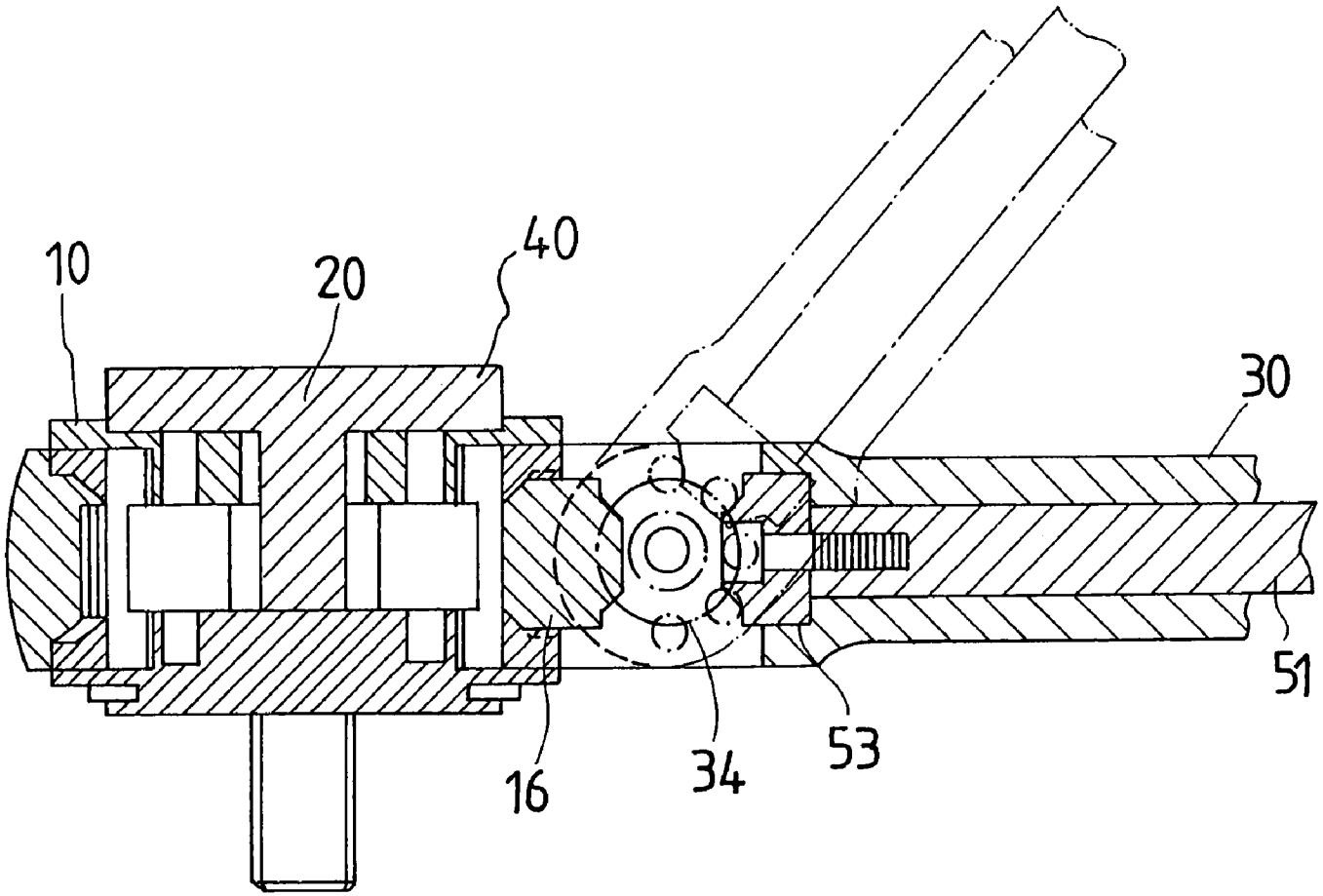
FIG. 3 is a partial cross sectional view illustrating a driving operation of the swing head structure.
Figure 6:
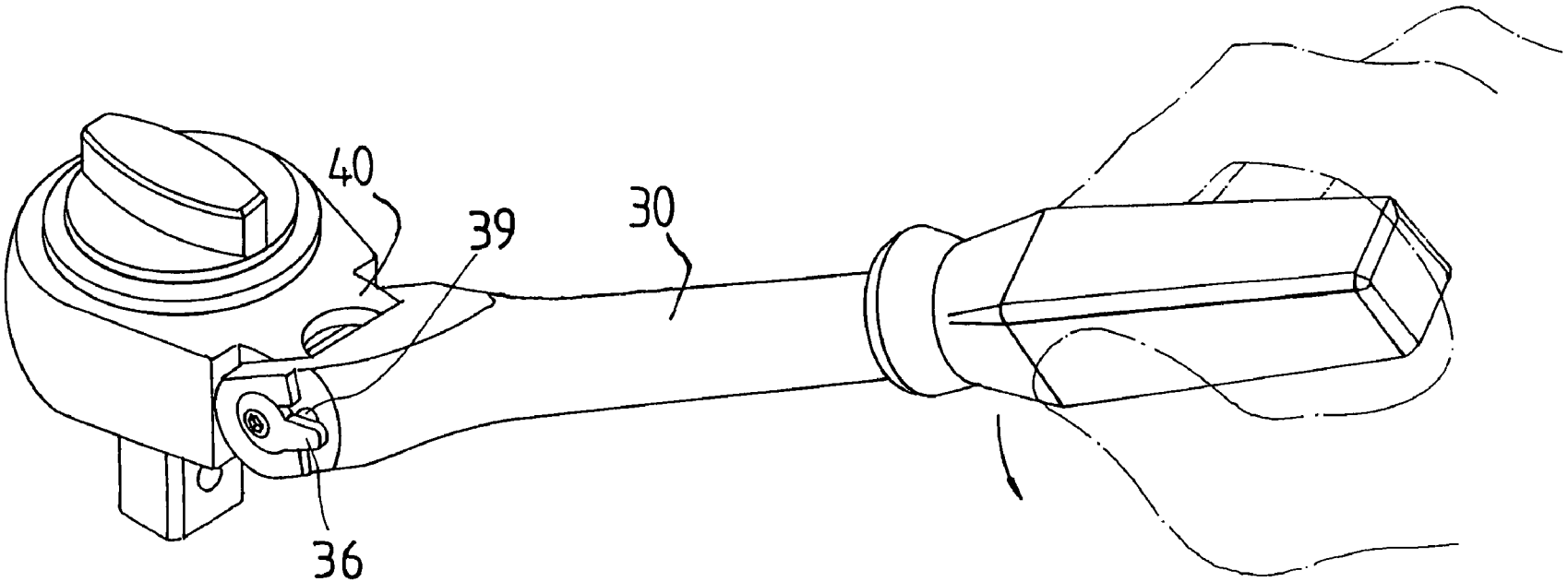
FIG. 6 is a perspective view illustrating the rotational operation of the swing head structure.

Referring to FIGS. 2, 3 and 6, if it is going to adjust the swing movement, the switch-control 36 can be turned so that it does not press against the steel ball 39, then the sleeve socket 10 can be rotated relative to the bolt 33 as its axis, the transmission gear 16 will rotate together with the medium gear 34, until the desired position is reached, turn the switch-control 36 again to make the steel ball 39 to press against the concave dot 43 of the protruded ear 40 of the sleeve socket 10, so that the sleeve socket 10 can be fixed to the long shaft 30 at the selected angle.

Figure 7:
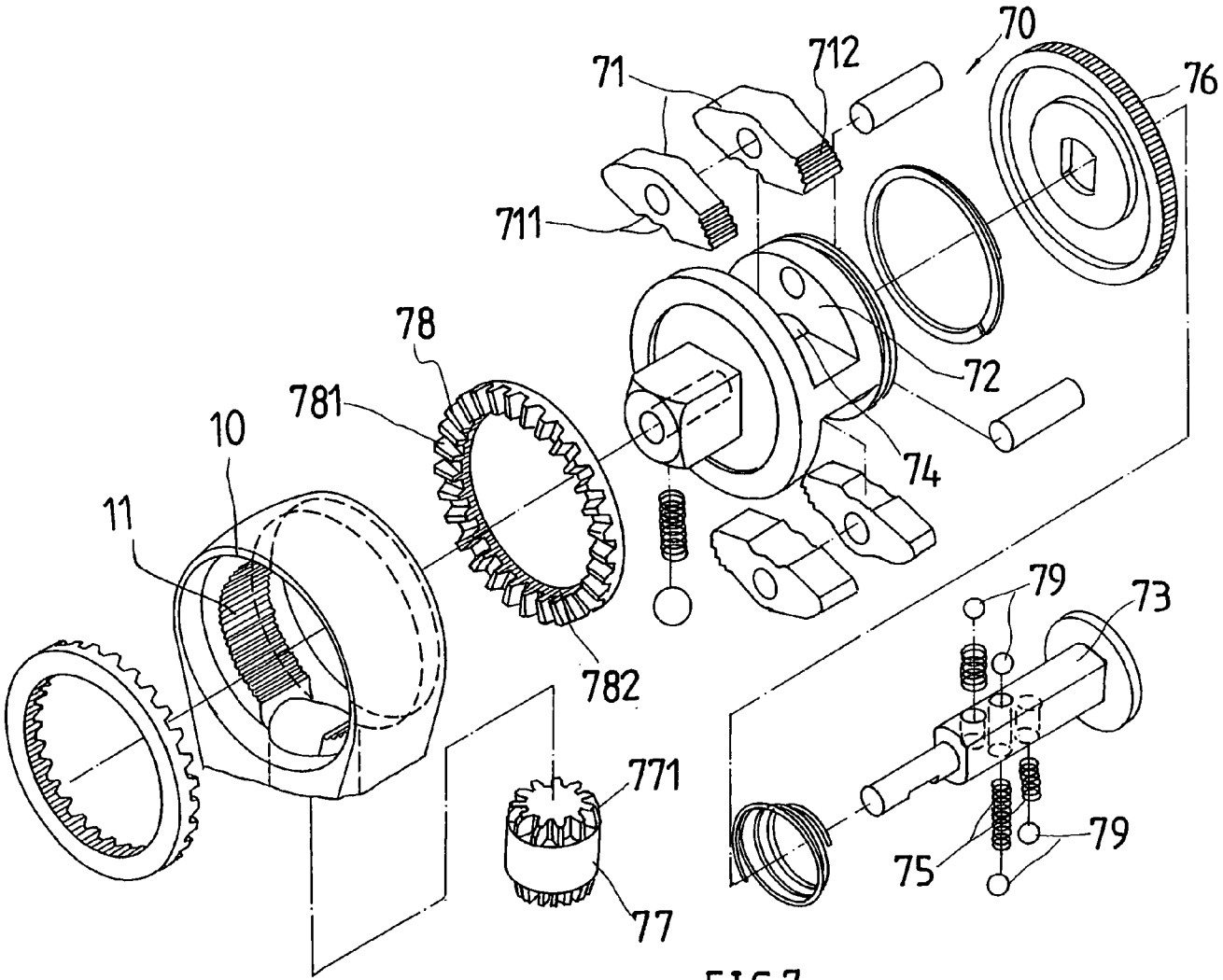
FIG. 7 is a partial exploded view of the wrench of the present invention.

Referring to FIG. 7, a ratchet head 70 includes two placing troughs 72 for placing two locking pieces 71 respectively, and a hole 74 for receiving an initiate piece 73, the two locking pieces 71 each include a positioning trough 711 formed in its inner end. The initiate piece 73 includes a positioning steel ball 79 and an elastic element 75 corresponding to each positioning trough 711. The initiate piece 73 is turned and adjusted by a wheel 76 to make the locking piece 71 swing in an opposite direction. The two locking pieces 71 are disposed within the ring-shaped gears 78. The two ring-shaped gears 78 each includes ratchet teeth 781, which can be meshed with an inclined wheel 771 that is disposed on top of a transmission shaft 77. The two ring-shaped gears 78 each include an inner ratchet gear 782, while an outer ratchet gear 712 is disposed outside the two locking pieces 71.

Figure 9:
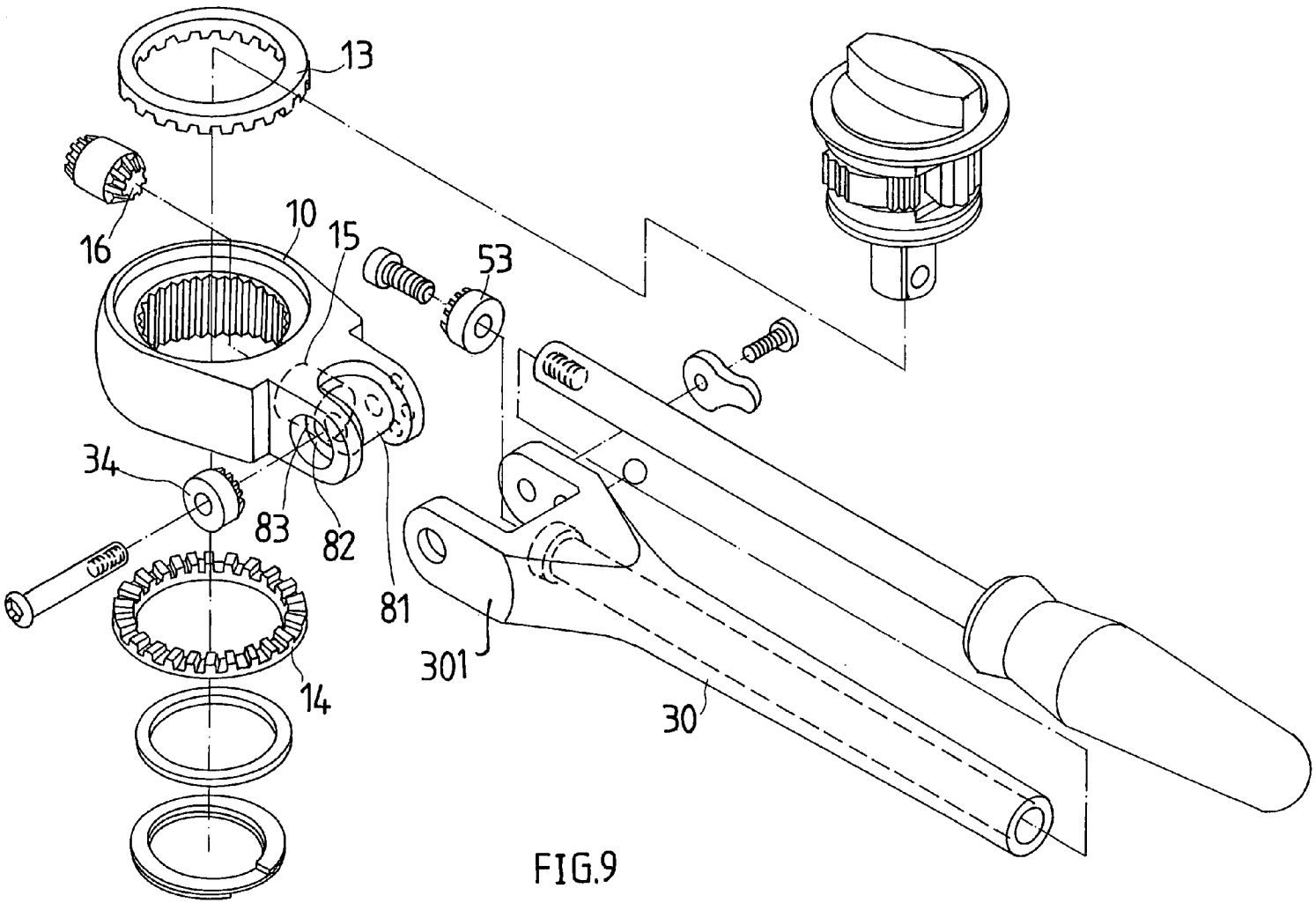
FIG. 9 is an exploded view illustrating a further embodiment of the wrench.

Referring to FIG. 9, a wrench includes a sleeve socket 10 on its one end, and a long shaft 30 on the other end, a first compartment 15 is formed inside the sleeve socket 10 for placing a transmission gear 16, a protruded piece 81 includes a second compartment 82 for placing a medium gear wheel 34. A passage part 83 is formed between the first compartment 15 and the second compartment 82, for allowing the sleeve socket 10 to be pivotally connected to the long shaft 30.

As for the swing head structure of the wrench, the sleeve socket 10 includes the protruded piece 81, the second compartment 82 is formed in the protruded piece 81 for placing the medium gear 34. The sleeve socket 10 includes the transmission gear 16 disposed inside to transmit two ring-shaped gears 13 and 14 that are disposed inside the sleeve socket 10, the medium gear 34 is engaged with a transmission gear 53 and the transmission gear 16 of the sleeve socket 10.

Figure 10:
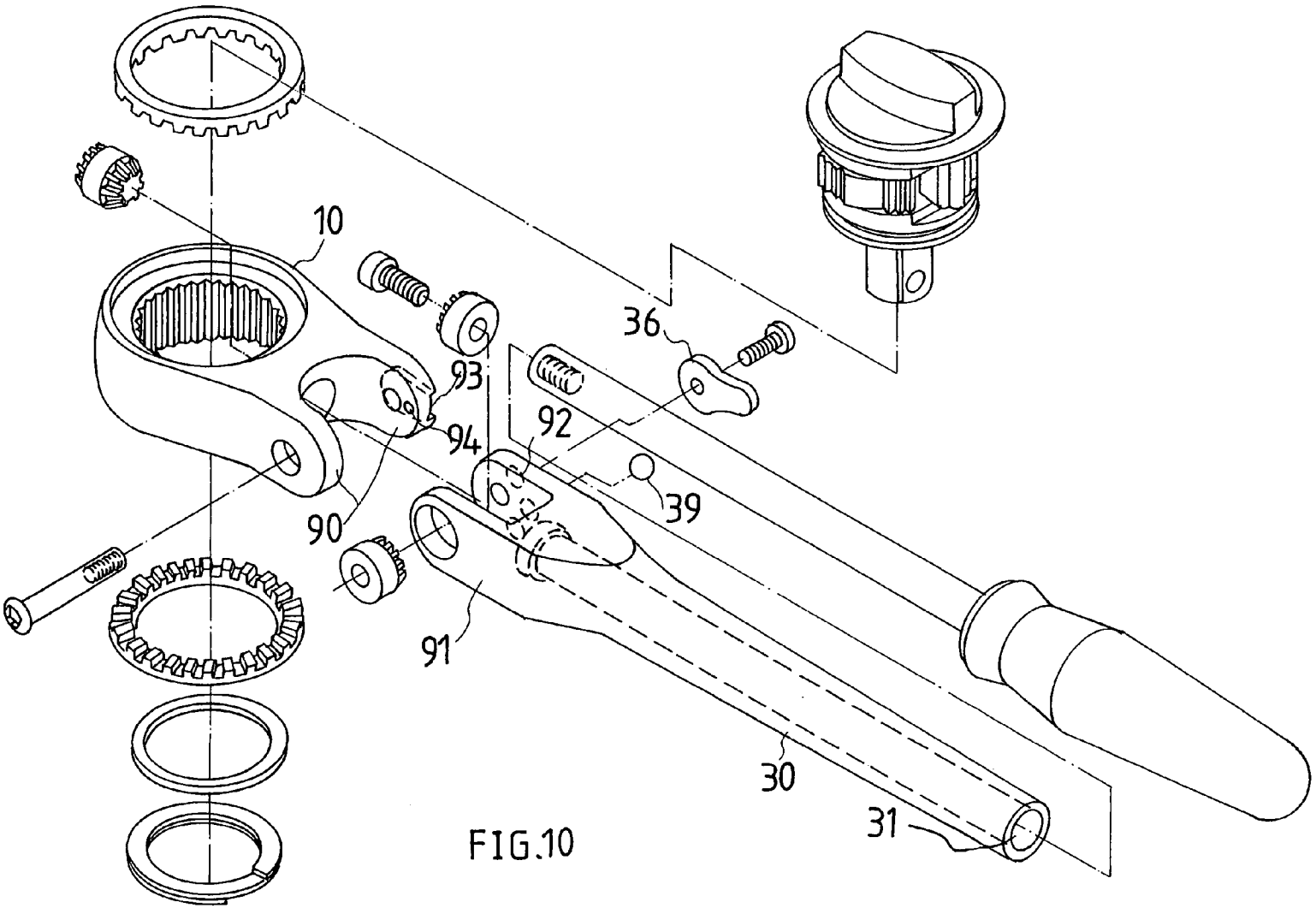
FIG. 10 is an exploded view illustrating a still further embodiment of the wrench.

Referring to FIG. 10, a sleeve socket 10 includes a protruded ear 90 for engaging on a protruded ear 91 of the long shaft 30. A plurality of concave dots 92 are formed in one side of the protruded ear 91 of the long shaft 30, a trough 93 is formed in one side of the protruded ear 90 for placing a switch-control 36, a steel ball hole 94 is formed in the protruded ear 90 for placing a steel ball 39, which can be controlled by the switch-control 36 and positioned on the concave dots 92.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A wrench comprising;

a sleeve socket including ratchet teeth disposed on an inner circumference thereof, and including an upper side and a bottom side, and including a compartment formed therein, and including a first protruded ear extended therefrom and including a hole formed in said first protruded ear, said first protruded ear of said sleeve socket including a plurality of concave dots formed thereon, a ratchet head engaged in said sleeve socket and selectively engaged with said ratchet teeth of said sleeve socket, two ring-shaped gears engaged on said upper side and said bottom side of said sleeve socket respectively, a first transmission gear rotatably received in said compartment of said sleeve socket, and meshed with said ring-shaped gears respectively, a medium gear rotatably received in said hole of said sleeve socket, and meshed with said first transmission gear, a long shaft including a second protruded ear extended from one end thereof and rotatably attached to said first protruded ear of said sleeve socket, and including a hollow hole formed through said long shaft, and a handle including a round shaft rotatably engaged through said hollow hole of said long shaft, and including a second transmission gear secured thereto and meshed with said medium gear, to allow said ring-shaped gears to be rotated relative to said sleeve socket by said handle with said medium gear, said first transmission gear of said sleeve socket, and said second transmission gear of said handle, and a steel ball disposed in said second protruded ear of said long shaft for selectively engaging with said concave dots of said first protruded ear of said sleeve socket.

2. The wrench as claimed in claim 1, wherein said handle includes a switch-control attached to said second protruded ear of said long shaft, for engaging with said steel ball, and for selectively making said steel ball to engage with said concave dots of said first protruded ear of said sleeve socket.

3. The wrench as claimed in claim 1, wherein said ratchet head includes two placing troughs and a hole formed therein, an initiate piece inserted into said hole of said ratchet head, and two locking pieces received in said placing troughs thereof respectively and each having a positioning trough formed therein, said initiate piece includes a positioning ball engaged in said positioning trough of said locking pieces.

* * * * *